US011189209B2

(12) United States Patent
Tian et al.

(10) Patent No.: US 11,189,209 B2
(45) Date of Patent: Nov. 30, 2021

(54) METHOD AND DEVICE FOR CORRECTING DISPLAY BRIGHTNESS OF DISPLAY MODULE, AND DISPLAY MODULE

(71) Applicants: Chengdu BOE Optoelectronics Technology Co., Ltd., Chengdu (CN); BOE Technology Group Co., Ltd., Beijing (CN)

(72) Inventors: Xuesong Tian, Beijing (CN); Renjie Ding, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/944,626

(22) Filed: Jul. 31, 2020

(65) Prior Publication Data

US 2021/0049947 A1 Feb. 18, 2021

(30) Foreign Application Priority Data

Aug. 14, 2019 (CN) ..... 201910750391.1

(51) Int. Cl.
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2320/0276* (2013.01); (Continued)

(58) Field of Classification Search
CPC ... G09G 2320/0276; G09G 2320/0626; G09G 2320/0673; G09G 3/2003; G09G 3/3225
See application file for complete search history.

(56) References Cited

U.S. PATENT DOCUMENTS 10,339,878 B2 * 7/2019 Chen ..... G09G 3/3607
2006/0176313 A1 8/2006 Xu et al.
(Continued)

FOREIGN PATENT DOCUMENTS

CN 1620102 A 5/2005
CN 101546547 A 9/2009
(Continued)

*Primary Examiner* — Kenneth Bukowski
(74) *Attorney, Agent, or Firm* — Arent Fox LLP; Michael Fainberg

(57) ABSTRACT

The present disclosure discloses a method and device for correcting display brightness of a display module and a display module. The method includes: receiving target brightness of the display module; determining target brightness components of sub-pixels of various colors corresponding to the target brightness according to a chromaticity coordinate of the target brightness and characteristics of luminescence of the sub-pixels of various colors in the display module; determining an initial gamma register value according to the target brightness components of the sub-pixels of various colors corresponding to the target brightness; performing gamma correction on the display module according to the initial gamma register value, and detecting the display brightness; and in response to determining that a difference value between the display brightness and the target brightness exceeds a first preset range, correcting the display brightness by adjusting the initial gamma register value according to the difference value.

15 Claims, 4 Drawing Sheets

(52) U.S. Cl.
CPC ..... *G09G 2320/0626* (2013.01); *G09G 2320/0673* (2013.01)

(56) References Cited

U.S. PATENT DOCUMENTS

| | | | | |
|---|---|---|---|---|
| 2009/0010538 | A1* | 1/2009 | Kim | H04N 5/202 382/167 |
| 2009/0262114 | A1 | 10/2009 | Park et al. | |
| 2010/0259551 | A1* | 10/2010 | Kao | H04N 17/02 345/590 |
| 2010/0259686 | A1 | 10/2010 | Kao | |
| 2013/0201224 | A1* | 8/2013 | Kang | G09G 5/02 345/690 |
| 2014/0267785 | A1* | 9/2014 | Chen | G09G 5/02 348/189 |
| 2016/0196793 | A1* | 7/2016 | Xu | G09G 3/3611 345/694 |
| 2016/0307493 | A1* | 10/2016 | Song | G09G 3/3225 |
| 2018/0204530 | A1* | 7/2018 | He | G09G 5/00 |
| 2019/0172404 | A1 | 1/2019 | Zhu | |
| 2019/0130844 | A1* | 5/2019 | Yang | G09G 3/2007 |
| 2019/0213951 | A1 | 7/2019 | Li et al. | |

FOREIGN PATENT DOCUMENTS

| | | | | |
|---|---|---|---|---|
| CN | 101860765 | A | | 10/2010 |
| CN | 103985333 | A | | 8/2014 |
| CN | 108182914 | A | | 6/2016 |
| CN | 106409219 | A | | 2/2017 |
| CN | 107665666 | A | * | 2/2018 |
| CN | 107799081 | A | | 3/2018 |
| CN | 108039143 | A | | 5/2018 |
| CN | 108063935 | A | | 5/2018 |
| CN | 108182914 | | * | 6/2018 |
| EP | 1772714 | A1 | | 4/2007 |

* cited by examiner

METHOD AND DEVICE FOR CORRECTING DISPLAY BRIGHTNESS OF DISPLAY MODULE, AND DISPLAY MODULE

This application claims priority to Chinese Patent Application No. 201910750391.1, filed Aug. 14, 2019, which is hereby incorporated by reference in its entirety.

FIELD

The present disclosure relates to the field of display, in particular to a method and device for correcting display brightness of a display module, and a display module.

BACKGROUND

In the related art, a method for correcting an active-matrix organic light emitting diode (AMOLED) display module generally includes the steps of firstly adjusting the brightness of a green pixel, then adjusting the brightness of a red pixel and a blue pixel to make the display brightness of a screen white picture reach a target brightness, and adjusting chromaticity coordinates.

SUMMARY

The present disclosure provides a method and device for correcting display brightness of a display module, and a display module.

In a first aspect, embodiments of the present disclosure provide a method for correcting display brightness of a display module. The method includes: receiving target brightness of the display module; determining target brightness components of sub-pixels of various colors corresponding to the target brightness according to a chromaticity coordinate of the target brightness and characteristics of luminescence of the sub-pixels of various colors in the display module; determining an initial gamma register value according to the target brightness components of the sub-pixels of various colors corresponding to the target brightness; performing gamma correction on the display module according to the initial gamma register value, and detecting the display brightness of the corrected display module; and in response to determining that a difference value between the display brightness and the target brightness exceeds a first preset range, correcting the display brightness by adjusting the initial gamma register value according to the difference value.

In some embodiments, the determining the target brightness components of the sub-pixels of various colors corresponding to the target brightness according to the chromaticity coordinate of the target brightness and the characteristics of luminescence of the sub-pixels of various colors in the display module includes: determining chromaticity coordinates of the sub-pixels of various colors according to the characteristics of luminescence of the sub-pixels of various colors in the display module; and calculating the target brightness components of the sub-pixels of various colors according to the chromaticity coordinates of the sub-pixels of various colors and the chromaticity coordinate of the target brightness.

In some embodiments, the calculating the target brightness components of the sub-pixels of various colors according to the chromaticity coordinates of the sub-pixels of various colors and the chromaticity coordinate of the target brightness includes: for each sub-pixel, calculating a first intermediate parameter value of the each sub-pixel based on a first factor and a second factor in the chromaticity coordinate of the each sub-pixel by a first preset calculation rule, where the first intermediate parameter value includes a first parameter component, a second parameter component and a third parameter component; calculating a second intermediate parameter value of the target brightness based on a third factor and a fourth factor in the chromaticity coordinate of the target brightness by a second preset calculation rule, where the second intermediate parameter value includes a first target component, a second target component and a third target component; obtaining a three-by-three first matrix by arranging first intermediate parameter values of the sub-pixels of various colors according to a first preset arrangement rule; determining an inverse matrix of the first matrix; and calculating the target brightness components according to the inverse matrix and the second intermediate parameter value.

In some embodiments, the first preset calculation rule is:

$$X_C=x_c/y_c, Y_C=1, Z_C=(1-x_c-y_c)-y_c,$$

where, $X_C$ represents the first parameter component, $Y_C$ represents the second parameter component, $Z_C$ represents the third parameter component, $x_c$ represents the first factor and $y_c$ represents the second factor;

the second preset calculation rule is:

$$X_T = \frac{x_t}{y_t} * L,\ Y_T = L,\ Z_T = \frac{1 - x_t - y_t}{y_t} * L,$$

where, $X_T$ represents the first target component, $Y_T$ represent the second target component, $Z_T$ represents the third target component, $x_t$ represents the third factor, $y_t$ represents the fourth factor, and L represents the target brightness.

In some embodiments, the calculating the target brightness components according to the inverse matrix and the second intermediate parameter value is performed by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix}, \text{ where}$$

$$\begin{bmatrix} X_R & X_G & X_B \\ Y_R & Y_G & Y_B \\ Z_R & Z_G & Z_B \end{bmatrix}$$

represents the first matrix, $$\begin{bmatrix} X_T \\ Y_T \\ Z_T \end{bmatrix}$$

represents a second matrix corresponding to the second intermediate parameter value, $$\begin{bmatrix} R_T \\ G_T \\ B_T \end{bmatrix}$$

and represents a third matrix corresponding to the target brightness components.

In some embodiments, the determining the chromaticity coordinates of the sub-pixels of various colors according to the characteristics of luminescence of the sub-pixels of various colors in the display module includes: judging whether brightness change of the sub-pixels of various colors is in a second preset range of brightness in a chromaticity diagram spectrum; and determining the chromaticity coordinates of the sub-pixels of various colors according to brightness of the sub-pixels of various colors in the chromaticity diagram spectrum, in response to the brightness change of the sub-pixels of various colors being in the second preset range.

In some embodiments, the method further includes: in response to that brightness change of a sub-pixel of a first color in the sub-pixels of various colors exceeds the second preset range, determining a first preset target brightness component of the sub-pixel of the first color from a preset target brightness component set; determining a first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors from the chromaticity diagram spectrum, where the first color, the second color and the third color are one of red, green and blue, respectively; calculating a first reference target brightness component of the sub-pixel of the first color according to the preset chromaticity coordinate of the sub-pixel of the first color, the chromaticity coordinate of the sub-pixel of the second color, the chromaticity coordinate of the sub-pixel of the third color and the chromaticity coordinate of the target brightness; determining whether a difference value between the first reference target brightness component and the first preset target brightness component is in a third preset range; and in response to that the difference value is in the third preset range, taking the preset chromaticity coordinate as the chromaticity coordinate of the sub-pixel of the first color.

In some embodiments, the method further includes: in response to that the difference value exceeds the third preset range, determining a second preset target brightness component from the preset brightness component set; and in response to that a difference value between a second reference target brightness component of the sub-pixel of the first color and the second preset target brightness component is in the third preset range, taking a chromaticity coordinate corresponding to the second preset target brightness as the chromaticity coordinate of the sub-pixel of the first color.

In some embodiments, the determining the second preset target brightness component from the preset brightness component set includes: randomly determining a preset brightness component from the preset brightness component set; determining a second preset chromaticity coordinate corresponding to the preset brightness component by bringing the preset brightness component into the chromaticity diagram spectrum; and in response to satisfying F(G)=G, taking the preset brightness component as the second preset target brightness component, wherein F is an operation of bringing the second preset chromaticity coordinate into the first preset calculation rule and the second preset calculation rule, and G represents target brightness of the sub-pixel of the first color; where the target brightness G of the sub-pixel of the first color is determined by following formula:

$$G_{K+1} = G_K - \frac{(F(G_K) - G_K) * (G_K - G_{K-1})}{(F(G_K) - G_K) - (F(G_{K-1}) - G_{K-1})},$$

where $G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time; and after performing at least one calculation, stopping iteration when $G_{K+1}$ is in the third preset range, and determining $G_{K+1}$ as the target brightness G of the sub-pixel of the first color.

In some embodiments, the first preset range is:

$$(L^*(1-\text{spec}), L^*(1+\text{spec})),$$

where L represents the target brightness, and spec represents an allowable range of brightness fluctuation.

In a second aspect, embodiments of the present disclosure provide a device for correcting display brightness of a display module. The device includes: a target brightness component determination element, configured for receiving target brightness of the display module, and determining target brightness components of sub-pixels of various colors corresponding to the target brightness according to a chromaticity coordinate of the target brightness and characteristics of luminescence of the sub-pixels of various colors in the display module; an initial gamma register value determination element, configured for determining an initial gamma register value according to the target brightness components of the sub-pixels of various colors corresponding to the target brightness; a detector, configured for performing gamma correction on the display module according to the initial gamma register value and detecting the display brightness of the corrected display module; and a display corrector, configured for correcting the display brightness by adjusting the initial gamma register value according to a difference value in response to determining that the difference value between the display brightness and the target brightness exceeds a first preset range.

In some embodiments, the target brightness component determination element is configured for: determining chromaticity coordinates of the sub-pixels of various colors according to the characteristic of luminescence of the sub-pixels of various colors in the display module; and calculating the target brightness components of the sub-pixels of various colors according to the chromaticity coordinates of the sub-pixels of various colors and the chromaticity coordinate of the target brightness.

In some embodiments, the target brightness component determination element is configured for: for each sub-pixel, calculating a first intermediate parameter value of the each sub-pixel based on a first factor and a second factor in the chromaticity coordinate of the each sub-pixel by a first preset calculation rule, wherein the first intermediate parameter value includes a first parameter component, a second parameter component and a third parameter component; calculating a second intermediate parameter value of the target brightness based on a third factor and a fourth factor in the chromaticity coordinate of the target brightness by a second preset calculation rule, wherein the second intermediate parameter value includes a first target component, a second target component and a third target component; obtaining a three-by-three first matrix by arranging first intermediate parameter values of the sub-pixels of various colors according to a first preset arrangement rule; determining an inverse matrix of the first matrix; and calculating the target brightness components according to the inverse matrix and the second intermediate parameter value.

In some embodiments, the first preset calculation rule is:

$$X_C = x_c / y_c,\ Y_C = 1,\ Z_C = (1 - x_c - y_c) - y_c,$$

where $X_C$ represents the first parameter component, $Y_C$ represents the second parameter component, $Z_C$ represents the third parameter component, $x_c$ represents the first factor and $y_c$ represents the second factor;

the second preset calculation rule is:

$$X_T = \frac{x_t}{y_t} * L,\ Y_T = L,\ Z_T = \frac{1 - x_t - y_t}{y_t} * L,$$

where $X_T$ represents the first target component, $Y_T$ represent the second target component, $Z_T$ represents the third target component, $x_t$ represents the third factor, $y_t$ represents the fourth factor, and L represents the target brightness.

In some embodiments, the target brightness component determination element is configured for calculating the target brightness components according to the inverse matrix and the second intermediate parameter value by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix},$$

where $\begin{bmatrix} X_R & X_G & X_B \\ Y_R & Y_G & Y_B \\ Z_R & Z_G & Z_B \end{bmatrix}$ represents the first matrix, $$\begin{bmatrix} X_T \\ Y_T \\ Z_T \end{bmatrix}$$

represents a second matrix corresponding to the second intermediate parameter value, and $$\begin{bmatrix} R_T \\ G_T \\ B_T \end{bmatrix}$$

represents a third matrix corresponding to the target brightness components.

In some embodiments, the target brightness component determination element is configured for: judging whether brightness change of the sub-pixels of various colors is in a second preset range of brightness in a chromaticity diagram spectrum or not; and determining the chromaticity coordinates of the sub-pixels of various colors according to brightness of the sub-pixels of various colors in the chromaticity diagram spectrum, in response to the brightness change of the sub-pixels of various colors being in the second preset range.

In some embodiments, the target brightness component determination element is configured for: in response to that brightness change of a sub-pixel of a first color in the sub-pixels of various colors exceeds the second preset range, determining a first preset target brightness component of the sub-pixel of the first color from a preset target brightness component set; determining a first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors from the chromaticity diagram spectrum, wherein the first color, the second color and the third color are one of red, green and blue, respectively; calculating a first reference target brightness component of the sub-pixel of the first color according to the preset chromaticity coordinate of the sub-pixel of the first color, the chromaticity coordinate of the sub-pixel of the second color, the chromaticity coordinate of the sub-pixel of the third color and the chromaticity coordinate of the target brightness; determining whether a difference value between the first reference target brightness component and the first preset target brightness component is in a third preset range; in response to that the difference value is in the third preset range, taking the preset chromaticity coordinate as the chromaticity coordinate of the sub-pixel of the first color; in response to that the difference value exceeds the third preset range, determining a second preset target brightness component from the preset brightness component set; and in response to that a difference value between a second reference target brightness component of the sub-pixel of the first color and the second preset target brightness component is in the third preset range, taking a chromaticity coordinate corresponding to the second preset target brightness as the chromaticity coordinate of the sub-pixel of the first color.

In some embodiments, the target brightness component determination element is configured for: randomly determining a preset brightness component from the preset brightness component set; determining a second preset chromaticity coordinate corresponding to the preset brightness component by bringing the preset brightness component into the chromaticity diagram spectrum; in response to satisfying F(G)=G, taking the preset brightness component as the second preset target brightness component, wherein F is an operation of bringing the second preset chromaticity coordinate into the first preset calculation rule and the second preset calculation rule, and G represents target brightness of the sub-pixel of the first color;

where the target brightness G of the sub-pixel of the first color is determined by following formula:

$$G_{K+1} = G_K - \frac{(F(G_K) - G_K) * (G_K - G_{K-1})}{(F(G_K) - G_K) - (F(G_{K-1}) - G_{K-1})},$$

where $G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time;

after performing at least one calculation, stopping iteration when $G_{K+1}$ is in the third preset range, and determining $G_{K+1}$ as the target brightness G of the sub-pixel of the first color.

In some embodiments, the first preset range is:

$$(L^*(1-\text{spec}), L^*(1+\text{spec})),$$

where L represents the target brightness, and spec represents an allowable range of brightness fluctuation.

In a third aspect, embodiments of the present disclosure provide a display module, where the display module is obtained after being corrected by the method of the first aspect.

DETAILED DESCRIPTION OF THE EMBODIMENTS

In order to make those skilled in the art better understand the schemes of the present disclosure, the schemes in the embodiments of the present disclosure will be clearly and completely described below with reference to the accompanying drawings.

It should be noted that the terms 'first', 'second' and the like in the description and claims of the present disclosure and in the accompanying drawings are configured for distinguishing between similar elements and not necessarily for describing a particular sequential or chronological order. It should be understood that the data so used may be interchanged under appropriate circumstances such that embodiments of the present disclosure described herein may be implemented in sequences other than those illustrated or described herein. The implementation modes described in the following exemplary examples do not represent all implementation modes consistent with the present disclosure. Rather, they are merely examples of devices and methods consistent with certain aspects of the present disclosure, as detailed in the appended claims.

As mentioned above, when display correction is performed on a display module, the display brightness of a screen white picture is first made to reach a target brightness and then chromaticity coordinates are adjusted, so that when the influence of brightness components of a red sub-pixel, a green sub-pixel and a blue sub-pixel on the target brightness cannot be known clearly, repeated trial adjustment may be performed only through experience, that is, the brightness and the chromaticity coordinates cannot rapidly reach the target values at the same time, which results in long display correction time and poor display correction efficiency for the display module.

In view of this, an embodiment of the present disclosure provides a method correcting display brightness of a display module. By adopting the method, the chromaticity coordinates of the sub-pixels of various colors can be accurately and quickly determined according to the characteristics of luminescence of the sub-pixels of various colors in the display module, the target brightness components of the sub-pixels of various colors can be obtained according to the chromaticity coordinates of the sub-pixels of various colors and the chromaticity coordinate of the target brightness, and the display module is corrected by adjusting a gamma register value.

Figure 1:
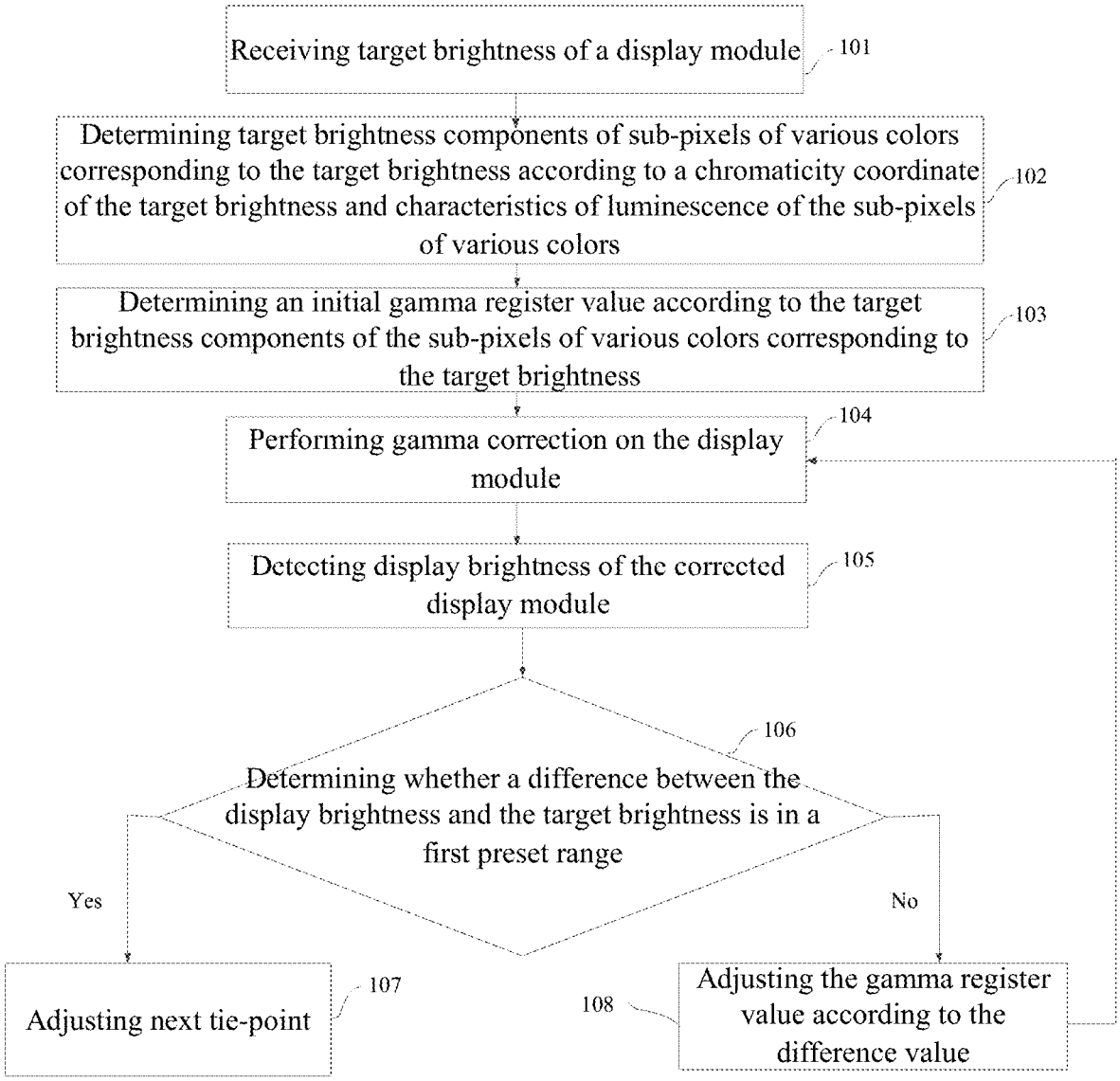
FIG. 1 is a flow diagram of a method for correcting display brightness of a display module according to embodiments of the present disclosure.

FIG. 1 is a flow diagram of a method for correcting display brightness of a display module according to an embodiment of the present disclosure. The flow of the method is described as follows.

Step 101: target brightness of the display module is received.

In an implementation process, display correction is a working procedure in an actual production process of the display module. Namely, the display module is subjected to display correction before delivery of the display module, and in an existing traditional display correction method, brightness and chromaticity coordinate values of different tie-points of the display module are tested and adjusted according to a certain sequence.

The display correction method of the display module provided by the embodiment of the present disclosure may be configured for performing display correction on an AMOLED display screen, and may also be configured for correcting other display screens needing display correction.

In some embodiments, a display correction mode for the display module may be adjustment of a red sub-pixel, a green sub-pixel and a blue sub-pixel corresponding to various gray scales, so that optical parameters such as brightness and chromaticity coordinates of the display module are adjusted to corresponding target values.

In the embodiments of the present disclosure, the schemes provided by the present disclosure are explained by a gamma correction method to realize correction of the display module.

In some embodiments, target brightness and s chromaticity coordinate of the target brightness given by a client for a display module to be corrected may be received.

In some embodiments, the received chromaticity coordinate may be based on a CIE-xy coordinate system. For example, the maximum white picture brightness normally used, namely the target brightness, is 450 nit, and the chromaticity coordinate corresponding to the target brightness is as follows: x=0.30, and y=0.31.

Step 102: target brightness components of sub-pixels of various colors corresponding to the target brightness are determined according to the chromaticity coordinate of the target brightness and characteristics of luminescence of the sub-pixels of various colors in the display module.

In the embodiments of the present disclosure, the chromaticity coordinates of the sub-pixels of various colors may be determined according to the characteristics of luminescence of the sub-pixels of various colors in the display module, and then the target brightness components of the sub-pixels of various colors are calculated according to the chromaticity coordinates of the sub-pixels of various colors and the chromaticity coordinate of the target brightness.

In some embodiments, the characteristics of luminescence of the sub-pixels of various colors of the display module to be corrected may be detected in advance, so that a chromaticity diagram spectrum may be obtained. In the chromaticity diagram spectrum, an abscissa represents brightness and an ordinate represents a chromaticity coordinate. Then whether brightness change of the sub-pixels of various colors is in a second preset range of brightness in the chromaticity diagram spectrum may be judged, so that the chromaticity coordinates of the sub-pixels of various colors may be determined.

In some embodiments, if the brightness change of the sub-pixels of various colors is in the second preset range, the chromaticity coordinates of the sub-pixels of various colors are determined according to the brightness of the sub-pixels of various colors in the chromaticity diagram spectrum.

Figure 2:
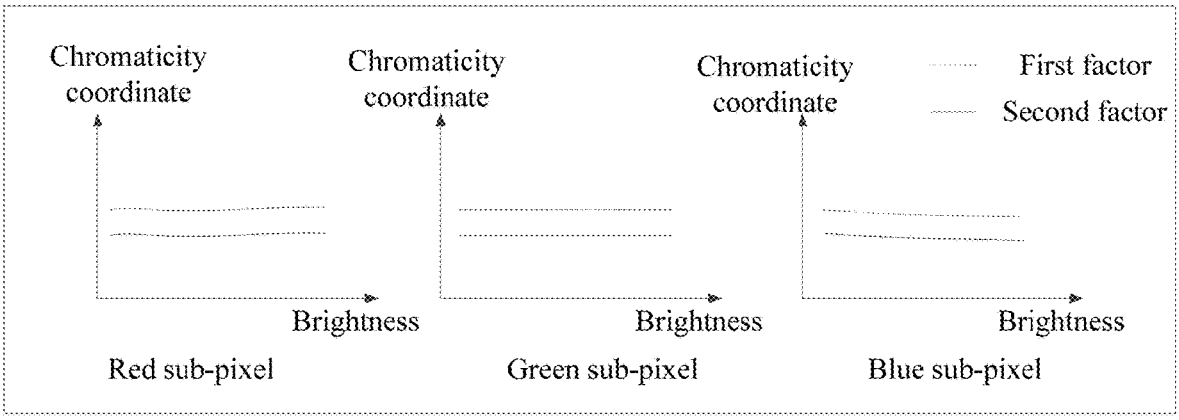
FIG. 2 is a schematic diagram of a chromaticity diagram spectrum according to embodiments of the present disclosure.

For example, referring to FIG. 2, the brightness change of the red sub-pixel, the brightness change of the green sub-pixel and the brightness change of the blue sub-pixel are in the second preset range, so that the chromaticity coordinates of the sub-pixels of various colors may be correspondingly determined according to the brightness of the red sub-pixel, the brightness of the green sub-pixel and the brightness of the blue sub-pixel in the chromaticity diagram spectrum.

In some embodiments, if brightness change of a sub-pixel of a first color in the sub-pixels of various colors exceeds the second preset range of brightness in the chromaticity diagram spectrum, a first preset target brightness component of the sub-pixel of the first color is determined from a preset brightness component set. A first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors are determined from the chromaticity diagram spectrum, where the first color, the second color and the third color are one of red, green and blue, respectively.

In some embodiments, a first reference target brightness component of the sub-pixel of the first color is calculated according to the first preset chromaticity coordinate of the sub-pixel of the first color, the chromaticity coordinate of the sub-pixel of the second color, the chromaticity coordinate of the sub-pixel of the third color and the chromaticity coordinate of the target brightness. Then whether a difference value between the first reference target brightness component and the first preset target brightness component is in a third preset range is determined; and if the difference value is in the third preset range, the first preset chromaticity coordinate is determined as the chromaticity coordinate of the sub-pixel of the first color.

Figure 3:
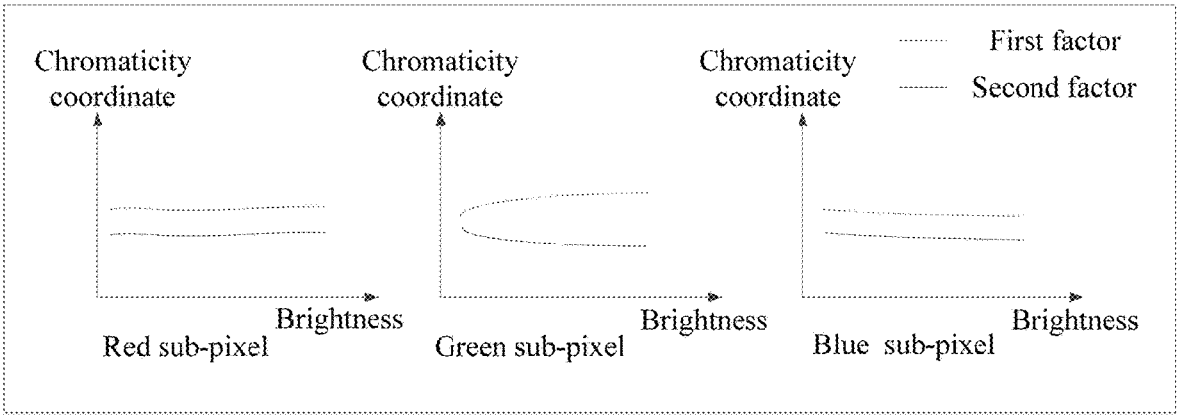
FIG. 3 is a schematic diagram of another chromaticity diagram spectrum according to embodiments of the present disclosure.

As shown in FIG. 3, the brightness change of the green sub-pixel exceeds the second preset range, a first preset target brightness component of the green sub-pixel may be determined from the preset brightness component set. A first preset chromaticity coordinate corresponding to the first preset target brightness component, a chromaticity coordinate corresponding to the brightness of the red sub-pixel and a chromaticity coordinate corresponding to the brightness of the blue sub-pixel are determined from the chromaticity diagram spectrum shown in FIG. 3. A first reference target brightness component of the green sub-pixel is calculated based on the first preset chromaticity coordinate, the chromaticity coordinate of the brightness of the red sub-pixel, the chromaticity coordinate of the brightness of the blue sub-pixel and the chromaticity coordinate of the target brightness. When it is determined that a difference value between the first reference target brightness component of the green sub-pixel and the first preset target brightness component is in the third preset range, the preset chromaticity coordinate is determined as the chromaticity coordinate of the green sub-pixel. The process of determining the chromaticity coordinates of the red sub-pixel and the blue sub-pixel is similar to that of the green sub-pixel, and will not be repeated in the embodiments of the present disclosure.

In some embodiments, if the difference value between the reference target brightness component of the sub-pixel of the first color and the first preset target brightness component is not in the third preset range, a second preset target brightness component is determined from the preset brightness component set. If a difference value between a second reference target brightness component of the sub-pixel of the first color and the second preset target brightness component is in the third preset range, the chromaticity coordinate corresponding to the second preset target brightness component is taken as the chromaticity coordinate of the sub-pixel of the first color.

Figure 4:
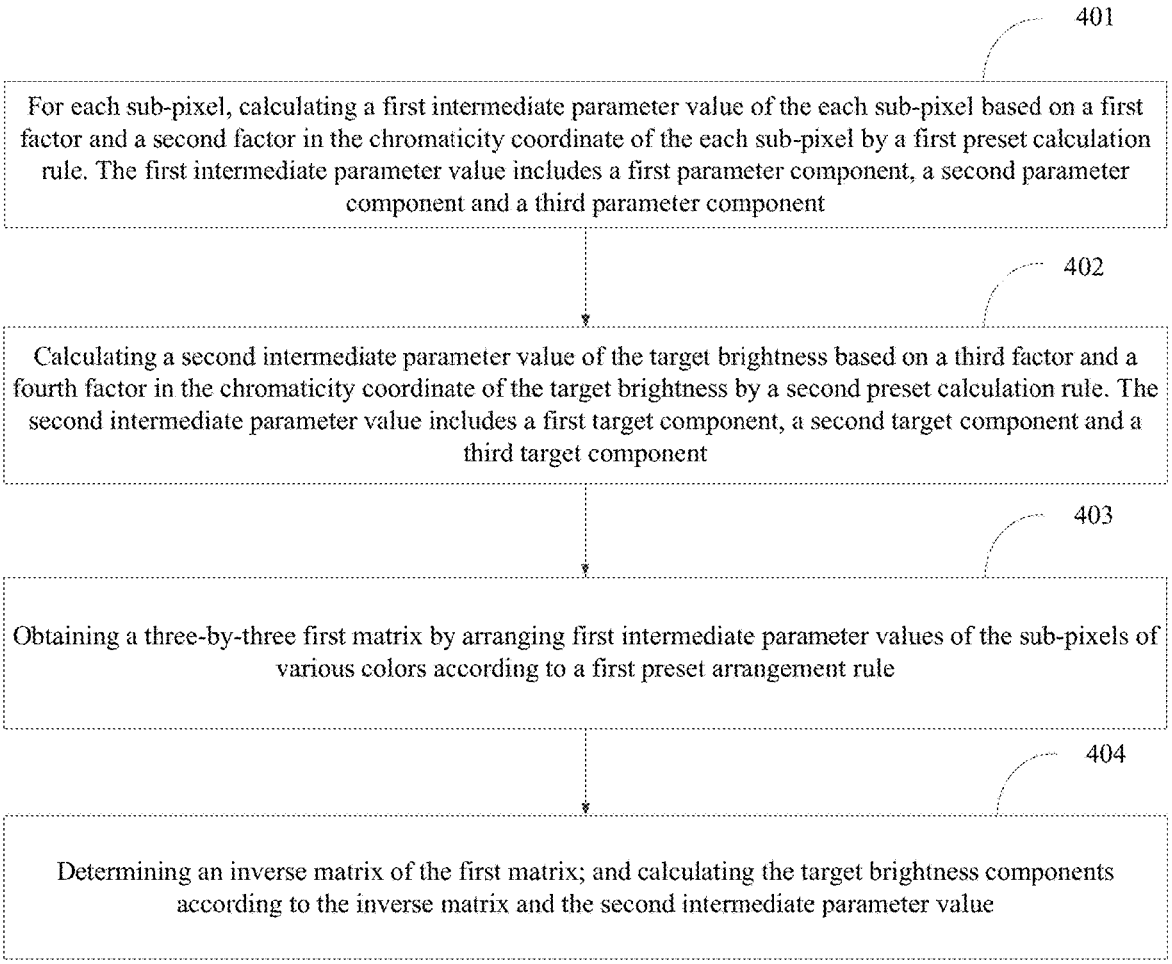
FIG. 4 is a flow diagram of a method for determining target brightness components of sub-pixels of various colors according to embodiments of the present disclosure.

In some embodiments, after the chromaticity coordinates of the sub-pixels of various colors are determined, the chromaticity coordinates of the sub-pixels of various colors may further be calculated with the chromaticity coordinate of the target brightness to obtain target brightness components of the sub-pixels of various colors. Referring to FIG. 4, the flow is as follows.

Step 401: for each sub-pixel, calculating a first intermediate parameter value of the each sub-pixel based on a first factor and a second factor in the chromaticity coordinate of the each sub-pixel by a first preset calculation rule. The first intermediate parameter value includes a first parameter component, a second parameter component and a third parameter component.

Step 402: calculating a second intermediate parameter value of the target brightness based on a third factor and a fourth factor in the chromaticity coordinate of the target brightness by a second preset calculation rule. The second intermediate parameter value includes a first target component, a second target component and a third target component.

Step 403: obtaining a three-by-three first matrix by arranging first intermediate parameter values of the sub-pixels of various colors according to a first preset arrangement rule.

Step 404: determining an inverse matrix of the first matrix; and calculating the target brightness components according to the inverse matrix and the second intermediate parameter value.

In some embodiments, the first preset calculation rule is:

$$X_C=x_c/y_c, Y_C=1, Z_C=(1-x_c-y_c)-y_c,$$

where $X_C$ represents the first parameter component, $Y_C$ represents the second parameter component, $Z_C$ represents the third parameter component, $x_c$ represents the first factor and $y_c$ represents the second factor;

the second preset calculation rule is:

$$X_T = \frac{x_t}{y_t} * L, Y_T = L, Z_T = \frac{1 - x_t - y_t}{y_t} * L,$$

$X_T$ represents the first target component, $Y_T$ represent the second target component, $Z_T$ represents the third target component, $x_t$ represents the third factor, $y_t$ represents the fourth factor, and L represents the target brightness.

In the embodiments of the present disclosure, in order to better explain the calculation process of the target brightness components of the sub-pixels of various colors in the schemes of the present disclosure, a red sub-pixel as the sub-pixel of the first color, a green sub-pixel as the sub-pixel of the second color and a blue sub-pixel as the sub-pixel of the third color are taken as examples for illustration.

In some embodiments, according to the foregoing mode, the chromaticity coordinate of the red sub-pixel is determined as $(x_r, y_r)$, the chromaticity coordinate of the green sub-pixel is determined as $(x_g, y_g)$, the chromaticity coordinate of the blue sub-pixel is determined as $(x_b, y_b)$. The first intermediate parameter values of the sub-pixels of various colors are obtained through calculation according to the first preset calculation rule. The first intermediate parameter value of the sub-pixel of each color in the sub-pixels of various colors includes a first parameter component, a second parameter component and a third parameter component.

In some embodiments, a process of calculating the first intermediate parameter values may be represented as follows:

$$X_R=x_r/y_r, Y_R=1, Z_R=(1-x_r-y_r)-y_r,$$

namely, the first intermediate parameter value of the red sub-pixel may be obtained, and $X_R$, $Y_R$ and $Z_R$ represent the first parameter component, the second parameter component and the third parameter component of the red sub-pixel, respectively.

$$X_G=x_g/y_g, Y_G=1, Z_G=(1-x_g-y_g)-y_g$$

namely, the first intermediate parameter value of the green sub-pixel may be obtained, and $X_G$, $Y_G$ and $Z_G$ represent the first parameter component, the second parameter component and the third parameter component of the green sub-pixel, respectively.

$$X_B=x_b/y_b, Y_B=1, Z_B=(1-x_b-y_b)-y_b,$$

namely, the first intermediate parameter value of the blue sub-pixel may be obtained, and $X_B$, $Y_B$ and $Z_B$ represent the first parameter component, the second parameter component and the third parameter component of the blue sub-pixel, respectively.

Further, the chromaticity coordinate of the target brightness is $(x_t, y_t)$, the target brightness is represented by L, and then the second intermediate parameter value of the target brightness is calculated based on the third factor $x_t$ and the fourth factor $y_t$ in the chromaticity coordinate of the target brightness by the second preset calculation rule. The second intermediate parameter value includes a first target component, a second target component and a third target component.

In some embodiments, a process of calculating the second intermediate parameter value is as follows:

$$X_T = \frac{x_t}{y_t} * L,\ Y_T = L,\ Z_T = \frac{1 - x_t - y_t}{y_t} * L,$$

namely, the second intermediate parameter value of the target brightness may be obtained, and $X_T$, $Y_T$ and $Z_T$ are the first target component, the second target component and the third target component, respectively.

In some embodiments, the calculating the target brightness components according to the inverse matrix and the second intermediate parameter value is performed by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix},$$

where, $\begin{bmatrix} X_R & X_G & X_B \\ Y_R & Y_G & Y_B \\ Z_R & Z_G & Z_B \end{bmatrix}$ represents the first matrix, $$\begin{bmatrix} X_T \\ Y_T \\ Z_T \end{bmatrix}$$

represents a second matrix corresponding to the second intermediate parameter value, and $$\begin{bmatrix} R_T \\ G_T \\ B_T \end{bmatrix}$$

represents a third matrix corresponding to the target brightness components.

That is, the target brightness components of the sub-pixels of various colors may be obtained through the foregoing process, namely the target brightness and chromaticity coordinate of the non-intuitive screen white picture are converted into more intuitive target brightness components of the sub-pixels of various colors. Therefore, display correction is more intuitive and accurate, and an intermediate adjustment process can be effectively reduced.

For example, the chromaticity coordinate of the red sub-pixel is $(x_r, y_r)=(0.6846, 0.3142)$, the chromaticity coordinate of the green sub-pixel is $(x_g, y_g)=(0.2634, 0.7045)$, the chromaticity coordinate of the blue sub-pixel is $(x_b, y_b)=(0.1349, 0.0557)$, the chromaticity coordinate of the target brightness is $(x_t, y_t)=(0.30, 0.31)$, the target brightness is L=450 nit, the value is substituted into the first preset calculation rule and the second preset calculation rule, and the following results can be obtained:

| | | | |
|---|---|---|---|
| $X_R = 2.17887$ | $X_G = 0.373882$ | $X_B = 2.421903$ | $X_T = 435.4839$ |
| $Y_R = 1$ | $Y_G = 1$ | $Y_B = 1$ | $Y_T = 450$ |
| $Z_R = 0.003183$ | $Z_G = 0.045564$ | $Z_B = 14.53142$ | $Z_T = 566.129.$ |

The first intermediate parameter values and the second intermediate parameter value are calculated to obtain: when the value is substituted into a formula shown in FIG. 1, the following results are obtained: $R_T$=104.9319 nit, $G_T$=307.095 nit, $B_T$=37.97307 nit, that is, if white light with the chromaticity coordinate of (0.30, 0.31) and the target brightness of 450 nit needs to be synthesized, the target brightness component, which is 104.9319 nit, of the red sub-pixel, the target brightness component, which is 307.095 nit, of the green sub-pixel and the target brightness component, which is 37.97307 nit, of the blue sub-pixel are required.

In some embodiments, when the difference value between the reference target brightness component of the sub-pixel of the first color and the first preset target brightness component is not in the third preset range, the second preset target brightness component is determined from the preset brightness component set.

Further, the determining the second preset target brightness component from the preset brightness component set includes following operations.

A preset brightness component is randomly determined from the preset brightness component set.

The preset brightness component is substituted into the chromaticity diagram spectrum, to determine a second preset chromaticity coordinate corresponding to the preset brightness component.

Operation of substituting the second preset chromaticity coordinate back into calculation formulas, i.e. the first preset calculation rule and the second preset calculation rule, of the first intermediate parameter value and the second intermediate parameter value is defined as F.

In response to satisfying F(G)=G, taking the preset brightness component as the second preset target brightness component, where G represents target brightness of the sub-pixel of the first color.

Specifically, it can be iterated according to a Newton iteration method in the following manner, to determine the target brightness G of the sub-pixel of the first color:

$$G_{K+1} = G_K - \frac{(F(G_K) - G_K) * (G_K - G_{K-1})}{(F(G_K) - G_K) - (F(G_{K-1}) - G_{K-1})}.$$

$G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time.

After performing at least one calculation, stopping iteration when $G_{K+1}$ is in the third preset range, and determining $G_{K+1}$ as the target brightness G of the sub-pixel of the first color.

In the embodiment of the present disclosure, after the sub-pixels of various colors are determined, the gamma register value may be correspondingly determined according to the determined target brightness components, and then the display module is corrected according to the gamma register value. The process is as shown in figures below, with continued reference to FIG. 1.

Step 103: the initial gamma register value is determined according to the target brightness components of the sub-pixels of various colors corresponding to the target brightness.

Step 104: the display module is subjected to gamma correction.

Step 105: the display brightness of the corrected display module is detected.

Step 106: whether the value of difference between the display brightness and the target brightness is in a first preset range is judged.

Step 107: if the value of difference between the display brightness and the target brightness is in the first preset range, a next tie-point is adjusted.

Step 108: if the value of difference between the display brightness and the target brightness is not in the first preset range, the gamma register value is adjusted according to the value of difference between the display brightness and the target brightness.

In the embodiments of the present disclosure, the display brightness of the display module corrected according to the initial gamma register value may be detected in real time according to an uncertain corresponding relation of the gamma register value, the brightness and the chromaticity coordinates, and if it is determined that the value of difference between the display brightness and the target brightness is not in the first preset range, the gamma register value may be adjusted according to the value of difference to correct the brightness of the display module. In some embodiments, the target brightness components of the sub-pixels of various colors may be converged to the target brightness in a PID control mode, so that display correction on the display module is realized.

In some embodiments, the first preset range is:

$$(L*(1-\text{spec}), L*(1+\text{spec})),$$

where L represents the target brightness, and spec represents an allowable range of brightness fluctuation.

For example, if the target brightness is 450 nit, the chromaticity coordinate is as follows: x=0.30, y=0.31, and spec of the brightness is 0.3%, it may be determined that the allowable range of the target brightness is 450*(1−0.3%) to 450*(1+0.3%), namely 448.65-451.35 nit, that is, the first preset range is minus 1.35 to 1.35. In some embodiments, spec of the brightness may be minus 0.3%.

Figure 5:
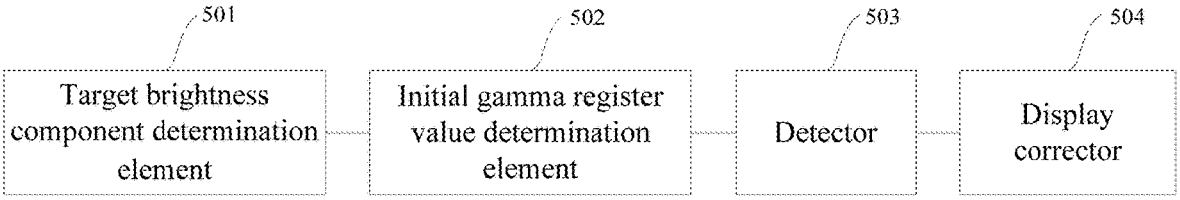
FIG. 5 is a structure diagram of a device for correcting display brightness of a display module according to embodiments of the present disclosure.

Based on the same inventive concept, the embodiment of the present disclosure further provides a display correction device of a display module, and since the method corresponding to the device in FIG. 5 is the display correction method of the display module in the embodiment of the present disclosure, implementation of the display correction device of the display module provided in the embodiment of the present disclosure may refer to implementation of the method, and the repetition of the description is omitted.

FIG. 5 is a structure diagram of a device for correcting display brightness of a display module according to an embodiment of the present disclosure. The device includes a target brightness component determination element 501, an initial gamma register value determination element 502, a detector 503 and a display corrector 504.

The target brightness component determination element 501 is configured for receiving target brightness of the display module, and determining target brightness components of sub-pixels of various colors corresponding to the target brightness according to a chromaticity coordinate of the target brightness and characteristics of luminescence of the sub-pixels of various colors in the display module.

The initial gamma register value determination element 502 is configured for determining an initial gamma register value according to the target brightness components of the sub-pixels of various colors corresponding to the target brightness.

The detector 503 is configured for performing gamma correction on the display module according to the initial gamma register value and detecting the display brightness of the corrected display module.

The display corrector 504 is configured for correcting the display brightness by adjusting the initial gamma register value according to a difference value in response to determining that the difference value between the display brightness and the target brightness is not in a first preset range.

In some embodiments, the target brightness component determination element 501 and the initial gamma register value determination element 502 may be a pattern generator or other hardware with the same function; and the detector 503 and the display corrector 504 may be a display color analyzer or other hardware with the same function. The pattern generator and the display color analyzer may perform the method for correcting display brightness of the display module as described in the above embodiments under the control of an industrial computer.

For example, the industrial computer writes the gamma register value into the display module (i.e. screen) via the pattern generator, so that the screen brightness can change; the display color analyzer collects the brightness of the screen and feeds it back to the industrial computer. The industrial computer calculates a difference value between the display brightness and the target brightness, adjusts the gamma register value, and writes the adjusted gamma register value into the display module through the pattern generator, and the cycle is kept until the brightness difference is within a predetermined range. The chromaticity coordinate of the brightness is collected via the display color analyzer, the processes of comparison and calculation are performed by the industrial computer, and the controlling of the display module is performed by the pattern generator.

In some embodiments, the target brightness component determination element 501 is configured for: determining chromaticity coordinates of the sub-pixels of various colors according to the characteristics of luminescence of the sub-pixels of various colors in the display module; and calculating the target brightness components of the sub-pixels of various colors according to the chromaticity coordinates of the sub-pixels of various colors and the chromaticity coordinate of the target brightness.

In some embodiments, the target brightness component determination element 501 is configured for: for each sub-pixel, calculating a first intermediate parameter value of the each sub-pixel based on a first factor and a second factor in the chromaticity coordinate of the each sub-pixel by a first preset calculation rule, where the first intermediate parameter value includes a first parameter component, a second parameter component and a third parameter component; calculating a second intermediate parameter value of the target brightness based on a third factor and a fourth factor in the chromaticity coordinate of the target brightness by a second preset calculation rule, where the second intermediate parameter value includes a first target component, a second target component and a third target component; obtaining a three-by-three first matrix by arranging first intermediate parameter values of the sub-pixels of various colors according to a first preset arrangement rule; determining an inverse matrix of the first matrix; and calculating the target brightness components according to the inverse matrix and the second intermediate parameter value.

In some embodiments, the first preset calculation rule is:

$$X_C=x_c/y_c, Y_C=1, Z_C=(1-x_c-y_c)-y_c,$$

where, $X_C$ represents the first parameter component, $Y_C$ represents the second parameter component, $Z_C$ represents the third parameter component, $x_c$ represents the first factor and $y_c$ represents the second factor;

the second preset calculation rule is:

$$X_T = \frac{x_t}{y_t} * L,\ Y_T = L,\ Z_T = \frac{1 - x_t - y_t}{y_t} * L,$$

where, $X_T$ represents the first target component, $Y_T$ represent the second target component, $Z_T$ represents the third target component, $x_t$ represents the third factor, $y_t$ represents the fourth factor, and L represents the target brightness.

In some embodiments, the target brightness component determination element 501 is configured for calculating the target brightness components according to the inverse matrix and the second intermediate parameter value by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix},$$

$$\begin{bmatrix} X_R & X_G & X_B \\ Y_R & Y_G & Y_B \\ Z_R & Z_G & Z_B \end{bmatrix}$$

represents the first matrix, $$\begin{bmatrix} X_T \\ Y_T \\ Z_T \end{bmatrix}$$

represents a second matrix corresponding to the second intermediate parameter value, and $$\begin{bmatrix} R_T \\ G_T \\ B_T \end{bmatrix}$$

represents a third matrix corresponding to the target brightness components.

In some embodiments, the target brightness component determination element 501 is configured for: judging whether brightness change of the sub-pixels of various colors is in a second preset range of the brightness in the chromaticity diagram spectrum; and determining the chromaticity coordinates of the sub-pixels of various colors according to brightness of the sub-pixels of various colors in the chromaticity diagram spectrum, in response to the brightness change of the sub-pixels of various colors being in the second preset range.

In some embodiments, the target brightness component determination element 501 is configured for: in response to that the brightness change of a sub-pixel of a first color in the sub-pixels of various colors exceeds the second preset range, determining a first preset target brightness component of the sub-pixel of the first color from a preset target brightness component set; determining a first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors from the chromaticity diagram spectrum, where the first color, the second color and the third color are one of red, green and blue, respectively; calculating a first reference target brightness component of the sub-pixel of the first color according to the preset chromaticity coordinate of the sub-pixel of the first color, the chromaticity coordinate of the sub-pixel of the second color, the chromaticity coordinate of the sub-pixel of the third color and the chromaticity coordinate of the target brightness; determining whether a difference value between the first reference target brightness component and the first preset target brightness component is in a third preset range; in response to that the difference value is in the third preset range, taking the preset chromaticity coordinate as the chromaticity coordinate of the sub-pixel of the first color.

In some embodiments, the target brightness component determination element 501 is configured for: in response to that the difference value exceeds the third preset range, determining a second preset target brightness component from the preset brightness component set; and in response to that a difference value between a second reference target brightness component of the sub-pixel of the first color and the second preset target brightness component is in the third preset range, taking a chromaticity coordinate corresponding to the second preset target brightness as the chromaticity coordinate of the sub-pixel of the first color.

In some embodiments, the target brightness component determination element 501 is configured for: randomly determining a preset brightness component from the preset brightness component set; determining a second preset chromaticity coordinate corresponding to the preset brightness component by bringing the preset brightness component into the chromaticity diagram spectrum; in response to satisfying F(G)=G, taking the preset brightness component as the second preset target brightness component, where F is an operation of bringing the second preset chromaticity coordinate into the first preset calculation rule and the second preset calculation rule, and G represents target brightness of the sub-pixel of the first color; where the target brightness G of the sub-pixel of the first color is determined by following formula:

$$G_{K+1} = G_K - \frac{(F(G_K) - G_K) * (G_K - G_{K-1})}{(F(G_K) - G_K) - (F(G_{K-1}) - G_{K-1})},$$

where $G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time; after performing at least one calculation, stopping iteration when $G_{K+1}$ is in the third preset range, and determining $G_{K+1}$ as the target brightness G of the sub-pixel of the first color.

In some embodiments, the first preset range is:

$$(L^*(1-\text{spec}), L^*(1+\text{spec})),$$

where L represents the target brightness, and spec represents an allowable range of brightness fluctuation.

Figure 6:
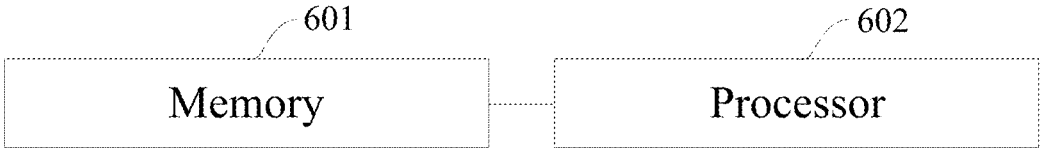
FIG. 6 is a structure diagram of another device for correcting display brightness of a display module according to embodiments of the present disclosure.

As shown in FIG. 6, the embodiments of the present disclosure provide a device for correcting display brightness of the display module. The device includes a memory 601 and at least one processor 602. The at least one processor 602 is configured to read and execute instructions stored in the memory 601 to perform the method for correcting display brightness of the display module.

The processor 602 may be a central processing unit (CPU), an application specific integrated circuit (ASIC), a field programmable gate array or a complex programmable logic device.

The embodiments of the present disclosure provide a display module. The display module is obtained after being corrected by the method according to the above embodiments.

In summary, in the embodiments of the present disclosure, the characteristics of luminescence of the sub-pixels of various colors in the display module are known in advance, the chromaticity coordinates of the sub-pixels of various colors may be accurately determined in the process of display correction on the display module, then the chromaticity coordinates of the sub-pixels of various colors and the chromaticity coordinate of the target brightness corrected for the display template are calculated, and the target brightness components of the sub-pixels of various colors may be obtained, namely the target brightness components of the sub-pixels of various colors may be adjusted accurately. The initial gamma register value may be determined according to the target brightness components of the sub-pixels of various colors, then the display module is subjected to gamma correction according to the initial gamma register value, the display brightness of the corrected display module is detected, when it is determined that the difference value between the display brightness and the target brightness is not in the first preset range, the gamma register value is adjusted according to the difference value to correct the brightness of the display module, namely the brightness of the display module can be rapidly adjusted to the target brightness, and the display correction efficiency of the display module is improved. In addition, color cast can be limited according to deviation values of the target brightness components of various colors, so that gray scale transition can be effectively improved.

It will be apparent to those skilled in the art that various changes and modifications may be made in the present disclosure without departing from the spirit and scope of the present disclosure. Thus, if such modifications and variations of the present disclosure fall within the scope of the claims of the present disclosure and their equivalents, the present disclosure is intended to include such modifications and variations as well.

The invention claimed is:

1. A method for correcting display brightness of a display module, comprising:

receiving target brightness of the display module;

determining chromaticity coordinates of sub-pixels of various colors according to characteristics of luminescence of the sub-pixels of various colors in the display module;

for each sub-pixel, calculating a first intermediate parameter value of the each sub-pixel based on a first factor and a second factor in the chromaticity coordinate of the each sub-pixel by a first preset calculation rule, wherein the first intermediate parameter value comprises a first parameter component, a second parameter component and a third parameter component;

calculating a second intermediate parameter value of the target brightness based on a third factor and a fourth factor in the chromaticity coordinate of the target brightness by a second preset calculation rule, wherein the second intermediate parameter value comprises a first target component, a second target component and a third target component;

obtaining a three-by-three first matrix by arranging first intermediate parameter values of the sub-pixels of various colors according to a first preset arrangement rule;

determining an inverse matrix of the first matrix; and calculating target brightness components according to the inverse matrix and the second intermediate parameter value;

determining an initial gamma register value according to the target brightness components of the sub-pixels of various colors corresponding to the target brightness;

performing gamma correction on the display module according to the initial gamma register value, and detecting the display brightness of the corrected display module; and in response to determining that a difference value between the display brightness and the target brightness exceeds a first preset range, correcting the display brightness by adjusting the initial gamma register value according to the difference value.

2. The method according to claim 1, wherein the first preset calculation rule is:

$$X_C=x_c/y_c, Y_C=1, Z_C=(1-x_c-y_c)-y_c,$$

wherein, $X_C$ represents the first parameter component of the sub-pixels of various colors, $Y_C$ represents the second parameter component of the sub-pixels of various colors, $Z_C$ represents the third parameter component of the sub-pixels of various colors, $x_c$ represents the first factor and $y_c$ represents the second factor, ($x_c$, $y_c$) represents a chromaticity coordinate of the sub-pixels of various colors;

the second preset calculation rule is:

$$X_T = \frac{x_t}{y_t} * L,\ Y_T = L,\ Z_T = \frac{1 - x_t - y_t}{y_t} * L,$$

wherein, $X_T$ represents the first target component of the sub-pixels of various colors, $Y_T$ represent the second target component of the sub-pixels of various colors, $Z_T$ represents the third target component of the sub-pixels of various colors, $x_t$ represents the third factor, $y_t$ represents the fourth factor, ($x_t$, $y_t$) represents the chromaticity coordinate of the target brightness, and L represents the target brightness.

3. The method according to claim 2, wherein the calculating the target brightness components according to the inverse matrix and the second intermediate parameter value is performed by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix}, \text{wherein,}$$

$$\begin{bmatrix} X_R & X_G & X_B \\ Y_R & Y_G & Y_B \\ Z_R & Z_G & Z_B \end{bmatrix}$$

represents the first matrix, $$\begin{bmatrix} X_T \\ Y_T \\ Z_T \end{bmatrix}$$

represents a second matrix corresponding to the second intermediate parameter value, and $$\begin{bmatrix} R_T \\ G_T \\ B_T \end{bmatrix}$$

represents a third matrix corresponding to the target brightness components, $X_R$ represents a first parameter component of a first color sub-pixel, $Y_R$ represents a second parameter component of the first color sub-pixel, $Z_R$ represents a third parameter component of the first color sub-pixel, $X_G$ represents a first parameter component of a second color sub-pixel, $Y_G$ represents a second parameter component of the second color sub-pixel, $Z_G$ represents a third parameter component of the second color sub-pixel, $X_B$ represents a first parameter component of a third color sub-pixel, $Y_B$ represents a second parameter component of the third color sub-pixel, $Z_B$ represents a third parameter component of the third color sub-pixel, $R_T$ represents a target brightness component of the first color sub-pixel, $G_T$ represents a target brightness component of the second color sub-pixel, $B_T$ represents a target brightness component of the third color sub-pixel.

4. The method according to claim 2, wherein the determining the chromaticity coordinates of the sub-pixels of various colors according to the characteristics of luminescence of the sub-pixels of various colors in the display module comprises:

judging whether brightness change of the sub-pixels of various colors is in a second preset range of brightness in a chromaticity diagram spectrum; and determining the chromaticity coordinates of the sub-pixels of various colors according to brightness of the sub-pixels of various colors in the chromaticity diagram spectrum, in response to the brightness change of the sub-pixels of various colors being in the second preset range.

5. The method according to claim 4, further comprising:

in response to that brightness change of a sub-pixel of a first color in the sub-pixels of various colors exceeds the second preset range, determining a first preset target brightness component of the sub-pixel of the first color from a preset target brightness component set;

determining a first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors from the chromaticity diagram spectrum, wherein the first color, the second color and the third color are one of red, green and blue, respectively;

calculating a first reference target brightness component of the sub-pixel of the first color according to the preset chromaticity coordinate of the sub-pixel of the first color, the chromaticity coordinate of the sub-pixel of the second color, the chromaticity coordinate of the sub-pixel of the third color and the chromaticity coordinate of the target brightness;

determining whether a difference value between the first reference target brightness component and the first preset target brightness component is in a third preset range; and in response to that the difference value is in the third preset range, taking the preset chromaticity coordinate as the chromaticity coordinate of the sub-pixel of the first color.

6. The method according to claim 5, further comprising:

in response to that the difference value exceeds the third preset range, determining a second preset target brightness component from the preset brightness component set; and in response to that a difference value between a second reference target brightness component of the sub-pixel of the first color and the second preset target brightness component is in the third preset range, taking a chromaticity coordinate corresponding to the second preset target brightness as the chromaticity coordinate of the sub-pixel of the first color.

7. The method according to claim 6, wherein the determining the second preset target brightness component from the preset brightness component set comprises:

randomly determining a preset brightness component from the preset brightness component set;

determining a second preset chromaticity coordinate corresponding to the preset brightness component by bringing the preset brightness component into the chromaticity diagram spectrum;

in response to satisfying F(G)=G, taking the preset brightness component as the second preset target brightness component, wherein F is an operation of bringing the second preset chromaticity coordinate into the first preset calculation rule and the second preset calculation rule, and G represents target brightness of the sub-pixel of the first color;

wherein the target brightness G of the sub-pixel of the first color is determined by following formula:

$$G_{K+1} = G_K - \frac{(F(G_K) - G_K) * (G_K - G_{K-1})}{(F(G_K) - G_K) - (F(G_{K-1}) - G_{K-1})},$$

wherein $G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time;

after performing at least one calculation, stopping iteration when $G_{K+1}$ is in the third preset range, and determining $G_{K+1}$ as the target brightness G of the sub-pixel of the first color.

8. The method according to claim 1, wherein the first preset range is:

$$(L^*(1-\text{spec}), L^*(1+\text{spec})),$$

wherein L represents the target brightness, and spec represents an allowable range of brightness fluctuation.

9. A device for correcting display brightness of a display module, comprising a memory configured to store a computer readable program, and a processor, wherein the processor is configured to read the computer-readable program to perform following method steps:

receiving target brightness of the display module;

determining chromaticity coordinates of sub-pixels of various colors according to characteristics of luminescence of the sub-pixels of various colors in the display module;

for each sub-pixel, calculating a first intermediate parameter value of the each sub-pixel based on a first factor and a second factor in the chromaticity coordinate of the each sub-pixel by a first preset calculation rule, wherein the first intermediate parameter value comprises a first parameter component, a second parameter component and a third parameter component;

calculating a second intermediate parameter value of the target brightness based on a third factor and a fourth factor in the chromaticity coordinate of the target brightness by a second preset calculation rule, wherein the second intermediate parameter value comprises a first target component, a second target component and a third target component;

obtaining a three-by-three first matrix by arranging first intermediate parameter values of the sub-pixels of various colors according to a first preset arrangement rule;

determining an inverse matrix of the first matrix; and calculating target brightness components according to the inverse matrix and the second intermediate parameter value;

determining an initial gamma register value according to the target brightness components of the sub-pixels of various colors corresponding to the target brightness;

performing gamma correction on the display module according to the initial gamma register value and detecting the display brightness of the corrected display module; and correcting the display brightness by adjusting the initial gamma register value according to a difference value in response to determining that the difference value between the display brightness and the target brightness exceeds a first preset range.

10. The device according to claim 9, wherein the first preset calculation rule is:

$$X_C = x_c / y_c, Y_C = 1, Z_C = (1 - x_c - y_c) - y_c,$$

wherein, $X_C$ represents the first parameter component of the sub-pixels of various colors, $Y_C$ represents the second parameter component of the sub-pixels of various colors, $Z_C$ represents the third parameter component of the sub-pixels of various colors, $x_c$ represents the first factor and $y_c$ represents the second factor, $(x_c, y_c)$ represents a chromaticity coordinate of the sub-pixels of various colors;

the second preset calculation rule is:

$$X_T = \frac{x_t}{y_t} * L, Y_T = L, Z_T = \frac{1 - x_t - y_t}{y_t} * L,$$

wherein, $X_T$ represents the first target component of the sub-pixels of various colors, $Y_T$ represent the second target component of the sub-pixels of various colors, $Z_T$ represents the third target component of the sub-pixels of various colors, $x_t$ represents the third factor, $y_t$ represents the fourth factor, $(x_t, y_t)$ represents the chromaticity coordinate of the target brightness, and L represents the target brightness.

11. The device according to claim 10, wherein the processor is configured to calculate the target brightness components according to the inverse matrix and the second intermediate parameter value by following formula:

$$\begin{bmatrix} X_R & X_G & X_B \\ Y_R & Y_G & Y_B \\ Z_R & Z_G & Z_B \end{bmatrix}^{-1} \begin{bmatrix} X_T \\ Y_T \\ Z_T \end{bmatrix} = \begin{bmatrix} R_T \\ G_T \\ B_T \end{bmatrix}, \text{wherein,}$$

-continued $$\begin{bmatrix} X_R & X_G & X_B \\ Y_R & Y_G & Y_B \\ Z_R & Z_G & Z_B \end{bmatrix}$$

represents the first matrix, $$\begin{bmatrix} X_T \\ Y_T \\ Z_T \end{bmatrix}$$

represents a second matrix corresponding to the second intermediate parameter value, $$\begin{bmatrix} R_T \\ G_T \\ B_T \end{bmatrix}$$

and represents a third matrix corresponding to the target brightness components, $X_R$ represents a first parameter component of a first color sub-pixel, $Y_R$ represents a second parameter component of the first color sub-pixel, $Z_R$ represents a third parameter component of the first color sub-pixel, $X_G$ represents a first parameter component of a second color sub-pixel, $Y_G$ represents a second parameter component of the second color sub-pixel, $Z_G$ represents a third parameter component of the second color sub-pixel, $X_B$ represents a first parameter component of a third color sub-pixel, $Y_B$ represents a second parameter component of the third color sub-pixel, $Z_B$ represents a third parameter component of the third color sub-pixel, $R_T$ represents a target brightness component of the first color sub-pixel, $G_T$ represents a target brightness component of the second color sub-pixel, $B_T$ represents a target brightness component of the third color sub-pixel.

12. The device according to claim 10, wherein the processor is configured for:

judging whether brightness change of the sub-pixels of various colors is in a second preset range of brightness in a chromaticity diagram spectrum or not; and determining the chromaticity coordinates of the sub-pixels of various colors according to brightness of the sub-pixels of various colors in the chromaticity diagram spectrum, in response to the brightness change of the sub-pixels of various colors being in the second preset range.

13. The device according to claim 12, wherein the processor is configured for:

in response to that brightness change of a sub-pixel of a first color in the sub-pixels of various colors exceeds the second preset range, determining a first preset target brightness component of the sub-pixel of the first color from a preset target brightness component set;

determining a first preset chromaticity coordinate corresponding to the first preset target brightness component, a chromaticity coordinate corresponding to brightness of a sub-pixel of a second color in the sub-pixels of various colors and a chromaticity coordinate corresponding to brightness of a sub-pixel of a third color in the sub-pixels of various colors from the chromaticity diagram spectrum, wherein the first color, the second color and the third color are one of red, green and blue, respectively;

calculating a first reference target brightness component of the sub-pixel of the first color according to the preset chromaticity coordinate of the sub-pixel of the first color, the chromaticity coordinate of the sub-pixel of the second color, the chromaticity coordinate of the sub-pixel of the third color and the chromaticity coordinate of the target brightness;

determining whether a difference value between the first reference target brightness component and the first preset target brightness component is in a third preset range;

in response to that the difference value is in the third preset range, taking the preset chromaticity coordinate as the chromaticity coordinate of the sub-pixel of the first color;

in response to that the difference value exceeds the third preset range, determining a second preset target brightness component from the preset brightness component set; and in response to that a difference value between a second reference target brightness component of the sub-pixel of the first color and the second preset target brightness component is in the third preset range, taking a chromaticity coordinate corresponding to the second preset target brightness as the chromaticity coordinate of the sub-pixel of the first color.

14. The device according to claim 13, wherein the processor is configured for:

randomly determining a preset brightness component from the preset brightness component set;

determining a second preset chromaticity coordinate corresponding to the preset brightness component by bringing the preset brightness component into the chromaticity diagram spectrum;

in response to satisfying F(G)=G, taking the preset brightness component as the second preset target brightness component, wherein F is an operation of bringing the second preset chromaticity coordinate into the first preset calculation rule and the second preset calculation rule, and G represents target brightness of the sub-pixel of the first color;

wherein the target brightness G of the sub-pixel of the first color is determined by following formula:

$$G_{K+1} = G_K - \frac{(F(G_K) - G_K) * (G_K - G_{K-1})}{(F(G_K) - G_K) - (F(G_{K-1}) - G_{K-1})},$$

wherein $G_{k+1}$ represents target brightness of the sub-pixel of the first color determined this time, $G_K$ represents target brightness of the sub-pixel of the first color determined last time adjacent to this time, and $G_{k-1}$ represents target brightness of the sub-pixel of the first color determined next time adjacent to this time;

after performing at least one calculation, stopping iteration when $G_{K+1}$ is in the third preset range, and determining $G_{K+1}$ as the target brightness G of the sub-pixel of the first color.

15. The device according to claim 13, wherein the first preset range is:

$$(L^*(1-\text{spec}), L^*(1+\text{spec})),$$

wherein L represents the target brightness, and spec represents an allowable range of brightness fluctuation.

* * * * *